US005365213A

United States Patent [19]

Paull et al.

[11] Patent Number: 5,365,213

[45] Date of Patent: Nov. 15, 1994

[54] WARNING DEVICE

[76] Inventors: Nathaniel H. Paull, 520 E. 81st St., Apt. 11-D, New York, N.Y. 10028; Howard P. Davis, 250 Gorge Rd., Apt. 9C, Cliffside Park, N.J. 07010

[21] Appl. No.: 41,827

[22] Filed: Apr. 1, 1993

[51] Int. Cl.[5] ..... G08B 23/00

[52] U.S. Cl. ..... 340/321

[58] Field of Search ..... 340/321

[56] References Cited

U.S. PATENT DOCUMENTS

| | | | |
|---|---|---|---|
| 1,173,269 | 2/1916 | Heidemann | 340/321 |
| 1,267,436 | 5/1918 | Martin | 340/321 |
| 1,504,980 | 8/1924 | Schultz | 340/321 |
| 1,682,598 | 10/1926 | Cook | 340/321 |
| 1,687,291 | 10/1928 | Graham | 340/321 |
| 2,172,167 | 9/1939 | Leventhal | 340/321 |
| 3,638,011 | 1/1972 | Bain et al. | 340/321 |

*Primary Examiner*—John K. Peng
*Assistant Examiner*—Nina Tong
*Attorney, Agent, or Firm*—Bachman & LaPointe

[57] ABSTRACT

A warning apparatus includes a body member for disposal around at least a portion of the hand and the wrist; a warning member for emitting a warning signal attached to the body member; and a switch for actuating the warning member attached to the body member so that the switch is substantially adjacent to at least one finger of the hand and being electrically connected to the warning member so that actuation of the switch causes the warning member to emit a warning signal. The apparatus preferably has at least two rigid protective support members arranged to follow front and back contours of the wrist.

10 Claims, 2 Drawing Sheets

WARNING DEVICE

BACKGROUND OF THE INVENTION

The invention relates to a hand and wrist worn warning device for use in issuing a warning signal when needed. The device is particularly suited for use in in-line skating, rollerskating, skateboarding, snowboarding and the like, as the signal can be used to give warning of the approach of the wearer of the device. Such a device could, of course, likewise be used to emit a warning signal in numerous other circumstances such as the approach of a potentially hostile person, or the falling and/or injury of a user during skateboarding, in-line skating, etc.

In-line skating, rollerskating, skateboarding, snowboarding and the like (collectively referred to hereafter as skating) typically involve travelling at relatively high rates of speed. When such an activity is conducted in areas where other persons or vehicles are present, either as pedestrians, other skaters, or in numerous other capacities, it is frequently difficult or impossible for such other persons or vehicles to detect the approach of a skater, particularly from behind.

While it is generally the responsibility of a skater to avoid persons or other objects in his path, it may be difficult to avoid persons or objects. This responsibility can be more easily met and safety enhanced if the other person can be effectively notified or alerted to the approach of the skater.

It is thus the primary object of the present invention to provide a hand and wrist worn device which can be utilized to emit warning signals as needed.

It is a further object of the invention to provide such a device which can be readily and effectively actuated by the user, even during periods of high stress where the warning signal is most likely to be needed.

It is a still further object of the invention to provide such a device with wrist support and protection members to protect the wrist of a user from injury during a fall or other accident.

Other objects and advantages will appear hereinbelow.

SUMMARY OF THE INVENTION

The foregoing objects and advantages are readily attained by the disclosed invention.

According to the invention, a warning apparatus is provided which comprises a body member for disposal around at least a portion of the hand and the wrist; warning means for emitting a warning signal attached to the body member; and switch means for actuating the warning means attached to the body member so that the switch means is substantially adjacent to at least one finger of the hand and being operatively connected to the warning means so that actuation of the switch means causes the warning means to emit a warning signal.

The apparatus may preferably further comprise at least one and preferably at least two rigid support members, disposed on the body member so as to follow contours of the wrist and thereby provide support for the wrist against impact which may occur during skating.

The body member may preferably comprise at least two layers of material, the switch means being electrically connected to the warning means through conductive means disposed between the at least two layers.

The conductive means are thereby shielded and protected from wear during use.

BRIEF DESCRIPTION OF THE DRAWINGS

A detailed description of the preferred embodiments of the invention follows, with reference to the attached drawings, wherein.

DETAILED DESCRIPTION

The invention relates to a wrist or hand worn warning device, especially interrelated with a wrist support particularly useful for in-line skating, rollerskating, skateboarding, snowboarding and the like, which can be utilized to emit a warning signal to persons or vehicles in the vicinity of the skater so as to alert the persons to the approach of the skater and, thus, help avoid collisions between them. The warning device of the present invention finds broad application wherever it is desired to warn of any dangerous condition, as for example, by hikers, joggers, and the like. Thus, the device, according to the invention, can suitably be used to signal for help in case of an accident or injury, or by any user to respond to the approach of a potentially hostile person. To further assist in safety, the warning device is uniquely combined with a wrist support device in the event danger cannot be avoided.

Figure 1:
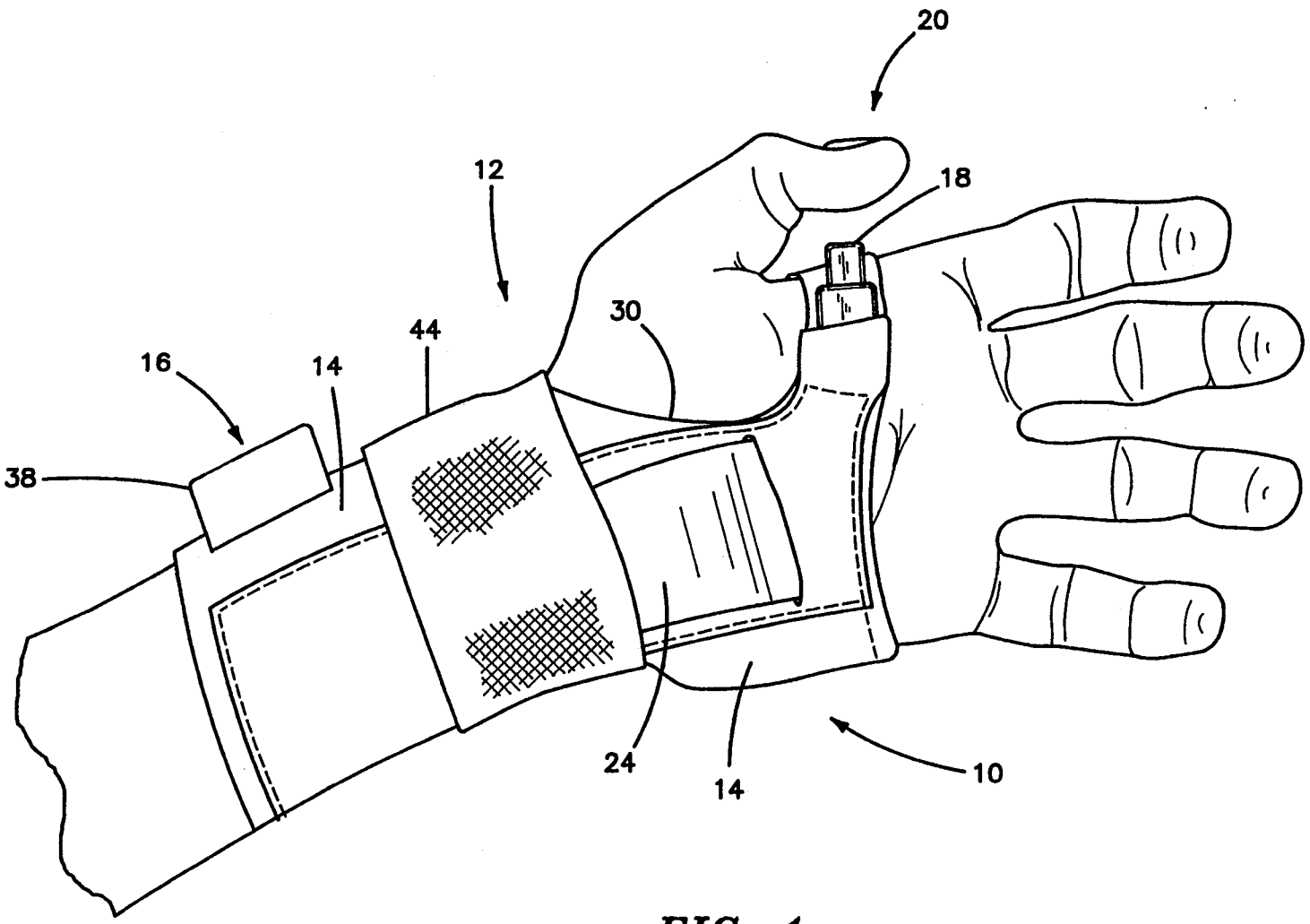
FIG. 1 shows a warning device, according to the invention, disposed for use on the wrist of a user.

FIG. 1 shows a warning device 10 disposed for use on the wrist 12 of a user.

As shown, device 10 has a substantially flexible body member 14 having a warning member 16 disposed thereon. The warning member 16 is preferably disposed on the inside of the wrist for protection, although it is shown in FIG. 1 on the top of the wrist for convenience of illustration. The specific location is not critical. As shown, body member 14 preferably extends around the wrist and at least a portion of the hand. A switch 18 is also disposed on body 14 for activating warning member 16, and is positioned so as to be substantially adjacent to or proximate to the thumb 20 of a user when body 14 is wrapped around wrist 12. In this manner, and advantageously, switch 18 is kept in position for use despite the potentially stressed conditions under which switch 18 may be needed. Such conditions could, otherwise, result in reorientation of the switch or dropping of the device at the precise time during which the device is needed most.

Body member 14 is adapted for disposal around the wrist and at least a portion of the hand. In this manner, device 10 is securely disposed around the hand and wrist of the wearer, thereby ensuring proper positioning of device 10 as described below. It should be noted that body member 14 could, of course, be a full or partial glove or have any other form suitable for providing the secure and proper positioning of device 10, according to the invention.

Figure 2:
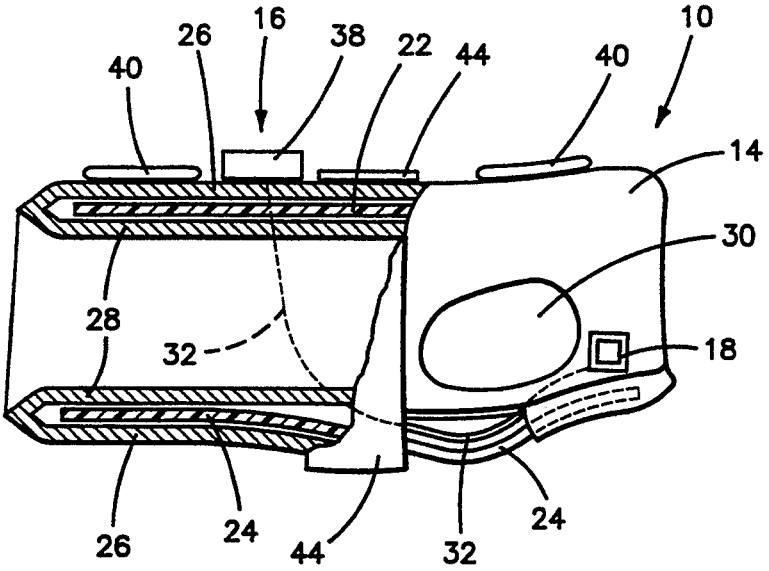
FIG. 2 is a cross-section of the device according to the invention.

Device 10 may preferably include structure for supporting and protecting the wrist such as substantially rigid plates 22, 24 (FIG. 2) disposed on body 14 which serve as a wrist guard or support when device 10 is used. Numerous other types of support could also be incorporated such as elastic support portions, protective padding and the like. Plates 22, 24 may be attached to body 14 in any convenient manner. FIG. 2 shows plates 22, 24 held to body 14 in pockets or flaps attached to body 14. For example, body 14 may preferably be made of at least two layers 26, 28 of material. Thus, plates 22, 24 may preferably be at least partially enclosed or "sandwiched" between outer layer 26 and inner layer 28.

Body 14 preferably has a thumb hole 30 through which the thumb is passed when device 10 is used, as shown in FIG. 1. Switch 18 is preferably disposed in close proximity or substantially adjacent to the thumb hole 30 so that switch 18 is readily accessible during periods of high stress use. In the embodiment shown, the switch is activated by the thumb; however, it may be desirable to orient the switch so that it may be activated by at least one finger. Switch 18 is also preferably attached to body 14 in such a manner that switch 18 is located in the palm of the hand so that switch 18 is both readily accessible and shielded from any exterior impacts to the hand.

Switch 18 is connected to warning member 16 through any typical means such as, for example, conductive elements, wiring 32 (as shown) and the like. Naturally, any desired and convenient means may be used for electrically connecting the switch 18 with warning member 16, such as the preferred wiring 32 as shown or providing an integral switch-warning member assembly, or radio frequency, wireless activation, all as desired. Wiring 32 is preferably disposed between layers 26 and 28, as shown in FIG. 2, so that wiring 32 is protected from external hazards. More preferably still, wiring 32 may be disposed partially or completely behind or inside of rigid member 24 so that, if a user falls while skating, wiring 32 will be further protected by rigid member 24.

Warning member 16 preferably includes a power source 34 (FIG. 3) and a signal emitter 36 which may suitably be disposed within a housing 38 mounted to body 14. The circuit (not shown) from power source 34 to signal emitter 36 is preferably opened and closed by switch 18 via wiring 32 so that warning member 16 can be actuated by manipulating switch 18.

Device 10 is typically fastened to the wrist of a user by inserting the thumb through thumb hole 30, and wrapping body 14 around the wrist as shown in FIG. 1. Various methods may be used to hold device 10 in place, such as straps, tie cords, velcro fasteners, buttons, elastic sections and the like.

The embodiment shown in the drawings is fastened in place by a number of tabs 40 having velcro surfaces 42 which are mated to adjustably and securely wrap body 14 about the users hand and wrist. An additional strap 44 may likewise be disposed around body 14 and secured with velcro as shown. Body 14, in this preferred embodiment, is made of a substantially flexible material so that the device can be snugly attached to the hand and/or wrist of a user. Body 14 flexibly adapts to the shape of the hand so that switch 18 and rigid plates 22, 24 are held securely and properly in place.

Power source 34 may be any suitable battery or other device such as, for example, a 9 volt battery. Signal emitter 36 may suitably be a horn or the like which may preferably be capable of producing a signal of about 90 db at about 7–12 volts. Of course, the foregoing are given by way of example only as regards suitable power source 34 and signal emitter 36, and any desired power source or horn could be substituted in accordance with the invention. The present invention preferentially contemplates a sound emitting warning device; however, one may of course use a visible warning means as a flashing light alone or in combination with the sound emitter.

In use, the aforedescribed device 10 provides a reliable and easily accessible means of warning persons or vehicles in the vicinity of a skater of the skater's approach. Further, plates 22, 24 serve to protect the wrist and palm of the user from impacts which are to be expected and are unavoidable during the referenced skating activities, and also shields wiring 32 of the device from such impacts, protecting the integrity of the device.

Figure 3:
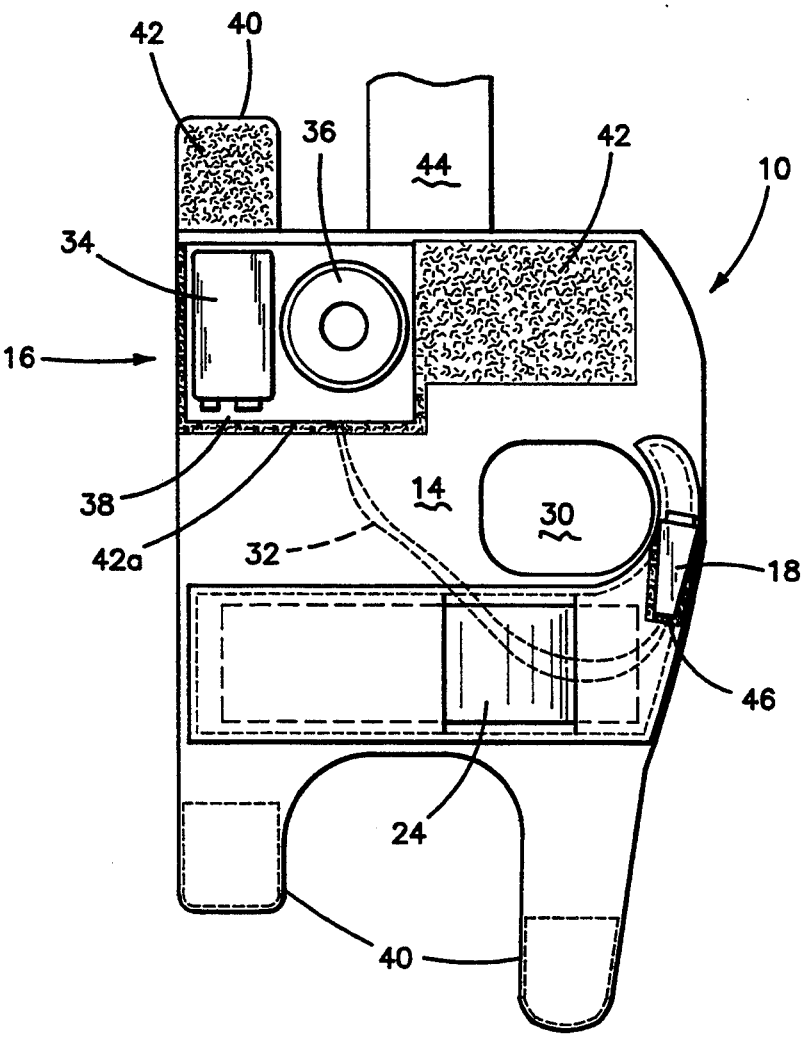
FIG. 3 is a top view of a warning device according to the invention.

Finally, it should be noted that, according to the invention, switch 18 and warning member 16 may be mounted to a wrist support as an adaptation add on feature with the use of double sided tape or velcro tape, or any other manner in which switch 18 and warning member 16 can be attached to the wrist support, preferably releasably attached, while maintaining switch 18 substantially adjacent to the thumb or other finger of the user for actuation. FIG. 3 shows an example of such an embodiment, wherein housing 38 of warning member 16 is attached to body member 14 through an extension **42*a* of velcro portion 42, and wherein switch 18 is also attached to body 14 with velcro tape 46**.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A warning apparatus, comprising:

a body member for disposal around at least a portion of the hand and the wrist of a user, wherein the body member includes at least in part two layers of material and at least one rigid support member at least in part between said two layers of material;

warning means operative to emit an audible warning signal attached to the body member;

switch means for actuating the warning means attached to the body member so that the switch means is substantially adjacent to at least one finger of the hand and being operatively connected to the warning means so that actuation of the switch means causes the warning means to emit said warning signal; and conductive means electrically connecting the switch means to the warning means, wherein the conductive means is disposed at least in part between said at least two layers of material and in addition at least in part behind said at least one rigid support member, wherein said rigid support member protects the integrity of the warning apparatus.

2. An apparatus according to claim 1, wherein said rigid support member further comprising support means for supporting the wrist of said user.

3. An apparatus according to claim 2 wherein the support means is operative to protect the wrist of said user.

4. An apparatus according to claim 1, including at least two of said rigid support members, wherein said at least two rigid support members are at least partially enclosed between said at least two layers of material.

5. An apparatus according to claim 4, wherein said conductive means is disposed at least partially behind at least one of the said at least two rigid support members.

6. An apparatus according to claim 1, wherein the warning means comprises a signal means for emitting said warning signal and a power source, mounted within a housing attached to the body member.

7. An apparatus according to claim 6, further including means for releasably attaching the housing and the switch means to the body member.

8. An apparatus according to claim 1, wherein the body member has a thumb hole, and wherein the switch means is mounted adjacent to the thumb hole so that, when the apparatus is disposed around the hand with the thumb inserted through the thumbhole, the switch means is substantially adjacent to the thumb.

9. An apparatus according to claim 8, wherein the switch means is attached to the body member so as to be positioned in a palm of the hand thereby shielding the switch means from exterior impacts with the hand.

10. An apparatus according to claim 1, wherein said at least two layers form a pocket, with said at least one support member being disposed therein.

* * * * *